US011708617B2

(12) United States Patent
Takeuchi et al.

(10) Patent No.: US 11,708,617 B2
(45) Date of Patent: Jul. 25, 2023

(54) BRICK LINING FORMING METHOD

(71) Applicant: KROSAKIHARIMA CORPORATION, Fukuoka (JP)

(72) Inventors: Kazuhiko Takeuchi, Fukuoka (JP); Satoshi Tsuboi, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 107 days.

(21) Appl. No.: 16/768,852

(22) PCT Filed: Nov. 19, 2018

(86) PCT No.: PCT/JP2018/042597
§ 371 (c)(1),
(2) Date: Jun. 1, 2020

(87) PCT Pub. No.: WO2019/111683
PCT Pub. Date: Jun. 13, 2019

(65) Prior Publication Data

US 2021/0140002 A1 May 13, 2021

(30) Foreign Application Priority Data

Dec. 6, 2017 (JP) ..... 2017-234403

(51) Int. Cl.
*C21B 7/06* (2006.01)
*C21C 5/44* (2006.01)
(Continued)

(52) U.S. Cl.
CPC ..... *C21B 7/06* (2013.01); *C21C 5/44* (2013.01); *F27D 1/04* (2013.01); *F27D 1/16* (2013.01)

(58) Field of Classification Search
CPC ..... C21B 7/06; C21C 5/44; F27D 1/04; F27D 1/045; F27D 1/16
(Continued)

(56) References Cited

U.S. PATENT DOCUMENTS 1,123,874 A * 1/1915 Hemmer ..... E04B 1/4178 432/247
3,272,490 A * 9/1966 Ross ..... C21C 5/44 266/286
(Continued)

FOREIGN PATENT DOCUMENTS

DE 3342078 * 3/1986 ..... C21B 7/06
EP 2365553 A1 9/2011
(Continued)

OTHER PUBLICATIONS

International Search Report dated Dec. 25, 2018, for PCT/JP2018/042597, filed Nov. 19, 2018.
(Continued)

*Primary Examiner* — Scott R Kastler
*Assistant Examiner* — Michael Aboagye
(74) *Attorney, Agent, or Firm* — Paul D. Bianco; Fleit Intellectual Property Law

(57) ABSTRACT

It is intended to provide a method for forming a brick lining to construct a sidewall of a kiln/furnace, while improving efficiency of brick lining forming work without causing any increase in manufacturing cost of bricks to be used. The brick lining forming method comprises stacking a plurality of tiers of bricks, respectively, on a plurality of tier regions of an inner surface of a hollow approximately cylindrical-shaped peripheral portion of a kiln/furnace to construct a side wall of the kiln/furnace, wherein two or more of the plurality of tier regions are different in terms of pre-lining radius, wherein only bricks identical in terms of taper angle
(Continued)

and height dimension are used, except for an adjustment brick, in each of the two or more tier regions different in terms of the pre-lining radius, wherein bricks identical in terms of the taper angle, the height dimension and length dimension, and different in terms of back face width, are used in at least a part of each of the two or more tier regions.

7 Claims, 3 Drawing Sheets

(51) Int. Cl.
*F27D 1/16* (2006.01)
*F27D 1/04* (2006.01)

(58) Field of Classification Search
USPC ..... 266/280, 243, 283, 286
See application file for complete search history.

(56) References Cited

U.S. PATENT DOCUMENTS 3,350,085 A * 10/1967 Over ..... F27D 1/04 266/283
3,894,729 A * 7/1975 Muller ..... C21C 5/4693 266/280
4,343,459 A * 8/1982 Kimmel ..... C21C 5/44 266/243
4,920,899 A * 5/1990 Blundy ..... F27B 14/02 266/281
5,316,268 A * 5/1994 Mantey ..... C21C 5/44 266/44
9,587,882 B2 * 3/2017 Piret ..... C21C 5/44
10,281,212 B2 * 5/2019 Yanagi ..... F27D 1/04
2004/0140598 A1 * 7/2004 Takahashi ..... C21C 5/44 266/283

FOREIGN PATENT DOCUMENTS

JP 2004-10936 A 1/2004
JP 2005009707 A 1/2005
JP 2005-336515 A 12/2005
JP 2015-148402 A 8/2015

OTHER PUBLICATIONS

Written Opinion for PCT/JP2018/042597, filed Nov. 19, 2018.
International Preliminary Report on Patentability dated Jun. 9, 2020, with Written Opinion, for PCT/JP2018/042597, filed Nov. 19, 2018 (English translation).

* cited by examiner

BRICK LINING FORMING METHOD

TECHNICAL FIELD

The present invention relates to a method for forming a brick lining to construct a hollow approximately cylindrical-shaped sidewall (inner sidewall) of a kiln/furnace, such as a blast furnace, an air heating furnace (hot blast stove), a converter, an electric furnace, a ladle, or a vacuum degassing furnace.

BACKGROUND ART

For example, a sidewall of a converter is typically constructed by sequentially arranging a plurality of bricks on an inner surface of a peripheral portion of the converter in a circumferential direction of the peripheral portion to form a tier of bricks, and stacking a plurality of the tiers of bricks along the peripheral portion in an upward-downward direction. Each of the bricks has a key (crown) shape or a similar shape thereto. Specifically, in a state in which the converter is lined with the bricks, each of the bricks has two circumferentially opposed side faces formed to define a tapered shape in a radially inward direction when view in the upward-downward direction. Heretofore, two types of bricks shaped differently in terms of taper angle have been used for lining each of a plurality of tier regions of the inner surface of the peripheral portion each corresponding to a respective one of the tiers of bricks. This is because such two types of differently-shaped bricks can be used in various combinations to cope with any lining even when lining two or more of the tier regions different in terms of pre-lining radius, in one kiln/furnace, so that it is possible to minimize the number of brick shapes, thereby suppressing a manufacturing cost of bricks. This method of combining the two types of bricks shaped differently in terms of the taper angle can also be applied to any of other kilns/furnaces slightly different in terms of inner diameter.

However, the above method requires preliminarily determining a combination (ratio) between the two types of differently-shaped bricks, and selecting one of the two types of differently-shaped bricks such that the selected brick is oriented in a direction more closely perpendicular to the peripheral portion than the other brick, in each circumferential region, thereby leading to a problem that brick lining forming work becomes complicated and requires time and effort.

With a view to solving this problem, there is a method which comprises preliminarily arranging (packing) the two types of differently-shaped bricks in a pallet in a given order. Although this method can facilitate kiln/furnace lining work, there is a problem that it takes time and effort for packing of the bricks. Moreover, during the brick lining forming work, it is necessary to check the bricks for shape one-by-one, although the bricks are arranged in the given order.

It is also conceivable to use a plurality of identically-shaped bricks in each of the tier regions. In this case, efficiency of the brick lining forming work is improved. However, it is necessary to prepare many kinds of differently-shaped bricks, for each of two or more of the tier regions different in terms of the pre-lining radius, or for each of plural types of kilns/furnaces different in terms of the pre-lining radius, thereby leading to a problem that it takes a lot of time for exchange work of molding dies (a metal frame and a vertical liner) during molding of the bricks.

CITATION LIST

[Parent Document]
Patent Document 1: JP 2005-009707A

SUMMARY OF INVENTION

Technical Problem

A technical problem to be solved by the present invention is to provide a method for forming a brick lining to construct a sidewall of a kiln/furnace, while improving efficiency of brick lining forming work without causing any increase in manufacturing cost of bricks to be used.

Solution to Technical Problem

The present invention provides a brick lining forming method having features described in the following sections 1 to 4.

(1) A brick lining forming method comprising stacking a plurality of tiers of bricks, respectively, on a plurality of tier regions of an inner surface of a hollow approximately cylindrical-shaped peripheral portion of a kiln or furnace to construct a side wall of the kiln or furnace, wherein two or more of the plurality of tier regions are different in terms of pre-lining radius of the kiln or furnace, wherein, assuming that, on a basis of a posture of each of the bricks in a state in which the kiln or furnace is lined with the bricks: two circumferentially opposed side faces of the brick are defined as circumferential side faces; an angle between the circumferential side faces is defined as a taper angle; and a circumferential dimension of a back face of the brick is defined as a back face width, only bricks identical in terms of the taper angle and height dimension are used, except for an adjustment brick, in each of the two or more tier regions different in terms of the pre-lining radius, wherein bricks identical in terms of the taper angle, the height dimension and length dimension, and different in terms of the back face width, are used in at least a part of each of the two or more tier regions.

(2) The method as described in the section 1, wherein only bricks identical in terms of the taper angle and the height dimension are used, except for an adjustment brick, in each of the remaining tier regions identical in terms of the pre-lining radius, wherein bricks identical in terms of the taper angle, the height dimension, the length dimension and the back face width, are used in at least a part of each of the remaining tier regions.

(3) The method as described in the section 1 or 2, 3, wherein each of the bricks is molded while pressure is uniaxially applied to a mixture in a manner allowing a pressure-receiving part of the mixture to be formed as at least one of the circumferential side faces.

(4) The method as described in any one of the sections 1 to 3, wherein the kiln or furnace is a converter.

Effect of Invention

In each of the two or more tier regions different in terms of the pre-lining radius, by using bricks identical in terms of the taper angle, the height dimension and the length dimension, it becomes possible to manufacture bricks shaped differently (in terms of back face width), while suppressing a manufacturing cost (molding cost) of the bricks. Specifically, during manufacturing of the bricks, each of the bricks is molded while pressure is applied to a mixture in a direction allowing a pressure-receiving part of the mixture to be formed as at least one of the circumferential side faces. Thus, bricks different in terms of the back face width can be molded by adjusting the amount of mixture to be used, without exchanging any liners used as upper and lower pressure-applying surfaces, so that it is possible to suppress the manufacturing cost.

Further, during lining to construct the sidewall of the kiln or furnace, the lining can be formed by continuously using basically identically-shaped bricks, so that it is possible to significantly improve efficiency of brick lining forming work. Additionally, there is no need to preliminarily arrange bricks in a given order, so that there is no concern about an increase in burden of packing work.

DESCRIPTION OF EMBODIMENTS

Figure 1A:
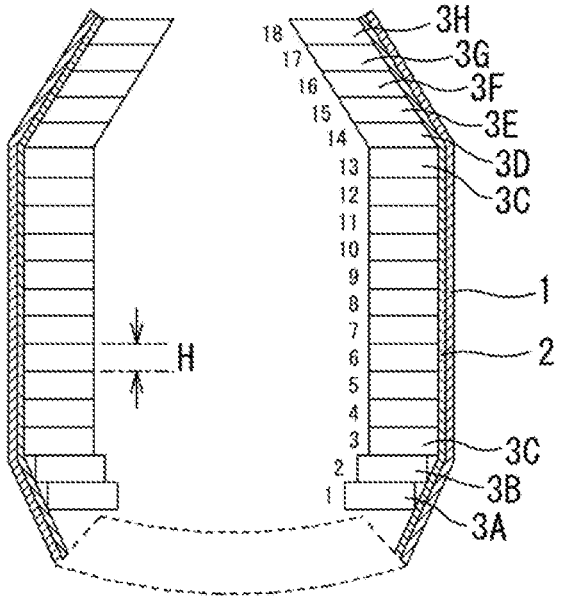
FIG. 1A is a vertical sectional view schematically showing a converter to explain a brick lining forming method according to one embodiment of the present invention.
Figure 1B:
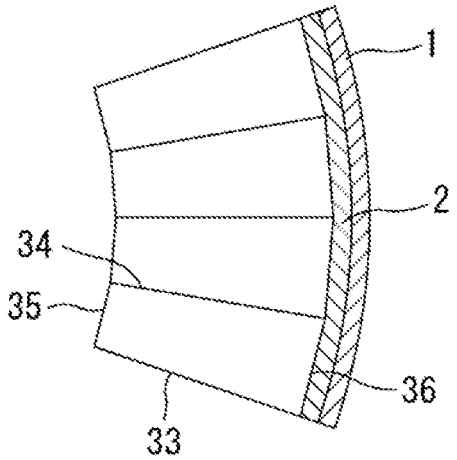
FIG. 1B is a partial cross-sectional view of a 7th tier of bricks, in a brick lining of a side wall of the converter illustrated in FIG. 1A.

FIG. 1A is a vertical sectional view schematically showing a converter to explain a brick lining forming method according to one embodiment of the present invention. FIG. 1B is a partial cross-sectional view of a 7th tier of bricks in a brick lining of a side wall of the converter illustrated in FIG. 1A. It should be noted here that illustration of bricks of a furnace bottom is omitted in FIG. 1A.

As shown in FIG. 1A, a lining of a permanent refractory material 2 is formed on an inner surface of a shell 1 to form a peripheral portion, and a lining of a plurality of bricks 3A to 3H as a lining material is formed on an inner surface of the permanent refractory material 2 to construct a sidewall of the converter. Specifically, in the sidewall of this converter, eighteen tiers of bricks are stacked (to form a lining), wherein all bricks used in the lining are identical in terms of after-mentioned taper angle, so that the number of bricks used in each of the tiers is the same. Further, all bricks used in the eighteen tiers are also identical in terms of length dimension. Here, this converter is formed such that it is cross-sectionally circular at any position, wherein, in cross-section, bricks are arranged as shown in FIG. 1B. As used in this specification, the term "circumferential side faces" of each brick means circumferentially opposed side faces 33, 34 of each of the bricks in a state in which a kiln/furnace is lined with the bricks, as shown in FIG. 1B.

In the peripheral portion of the sidewall of this converter, a straight barrel part whose inner surface consists of 3rd to 13th tier regions corresponding to 3rd to 13th tiers of bricks is constant in terms of pre-lining radius, whereas a remaining part whose inner surface consists of 1st, 2nd and 14th to 18th tier regions corresponding to 1st, 2nd and 14th to 18th tiers of bricks varies in terms of the pre-lining radius. Here, the term "pre-lining radius" means a distance between a central axis of the converter and the inner surface of the permanent refractory material.

Figure 2A:
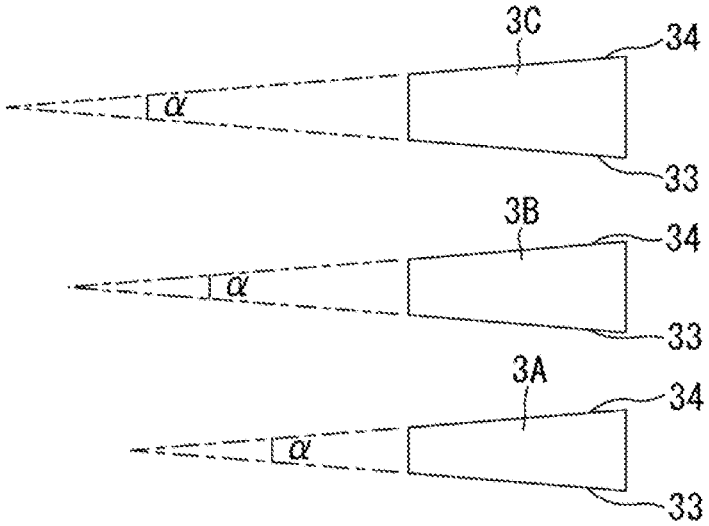
FIG. 2A is top plan views of three bricks to be used, respectively, in a 1st tier, a 2nd tier, and each of 3rd to 13th tiers, in the lining of the side wall of the converter illustrated in FIG. 1A.

FIG. 2A are top plan views showing, respectively, the brick 3A to be used in the 1st tier region, the brick 3B to be used in the 2nd tier region, and the brick 3C to be used in each of the 3rd to 13th tier regions. All the bricks 3A to 3C are identical in terms of taper angle $\alpha$. Here, the term "taper angle" of each brick means an angle $\alpha$ between the two circumferential side faces 33, 34.

FIG. 2A is a top plan view showing a state in which three types of bricks 3A to 3C to be used, respectively, in the 1st tier, the 2nd tier, and each of the 3rd to 13th tiers are superimposed on each other in their height direction, while the respective circumferential side faces 34 of the superimposed bricks 3A to 3C are arranged to be flush with each other. The undermost brick 3C is used in each of the 3rd to 13th tiers, i.e., disposed on the tier region having the largest pre-lining radius, so that it is largest in terms of after-mentioned back face width, among the bricks 3A to 3C. The back face width becomes smaller as the pre-lining radius becomes smaller. That is, the back face width W3 of the brick 3C (for each of the 3rd to 13th tiers)>the back face width W2 of the brick 3B (for the 2nd tier)>the back face width W1 of the brick 3A (for the 1st tier).

Figure 2B:
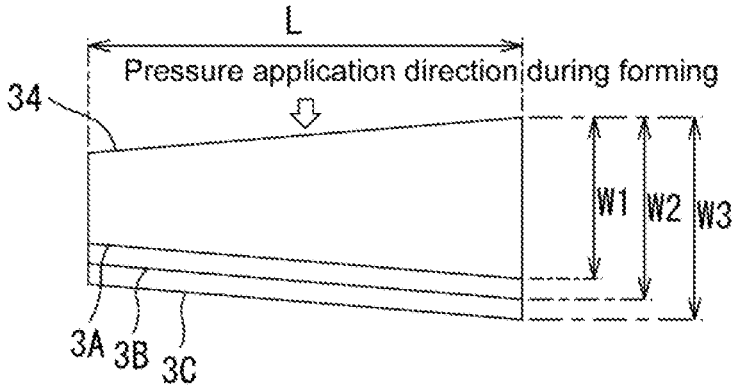
FIG. 2B is an explanatory diagram of the three bricks to be used, respectively, in the 1st tier, the 2nd tier, and the 3rd tier, in the lining of the side wall of the converter illustrated in FIG. 1A.
Figure 2C:
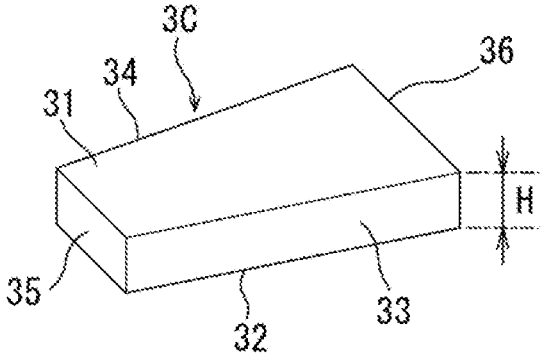
FIG. 2C is a perspective view of the brick to be used in each of the 3rd to 13th tiers, in the lining of the side wall of the converter illustrated in FIG. 1A.

FIG. 2C is a perspective view of the brick 3C to be used in each of the 3rd to 13th tiers. The brick 3C is formed in a so-called key (crown) shape, wherein each of two opposed side faces (circumferential side faces) extends in a length direction of the brick 3C obliquely at the same inclination angle to define trapezoidal (key)-shaped upper and lower faces each having the largest area. In the 1st and 2nd tiers, bricks different in terms of width dimension are used. In the present invention, on the basis of the posture of each of the bricks in a state in which the kiln/furnace is lined with the bricks, a circumferential dimension of a back face 36 of the brick and a circumferential dimension of an inner face 35 of the brick are defined, respectively, as a back face width and an inner face width, and a face 32 of the brick on the side of the bottom of the kiln/furnace and a face 31 of the brick on the side of the top of the kiln/furnace are defined, respectively, as a lower face and an upper face. Further, a dimension of the brick in a length direction of the kiln/furnace is defined as a height dimension H, and a dimension of the brick in a radial direction of the kiln/furnace is defined as a length dimension L.

As mentioned above, the three types of bricks 3A to 3C are identical in terms of the taper angle $\alpha$, the height dimension H and the length dimension L. Thus, during manufacturing of the bricks, each of the bricks is molded while pressure is uniaxially applied to a mixture in a manner allowing a pressure-receiving part of the mixture to be formed as one of the circumferential side faces 34, as shown in FIG. 2B, so that it is possible to mold the three types of bricks using a common set of a metal frame and a vertical liner. Here, the metal frame means a frame for forming the side of a brick during molding, and the vertical liner means a pair of upper and lower liners for forming the top and bottom of the brick during molding. The upper liner and/or the lower liner are configured to be moved within the metal frame in the upward-downward direction, thereby compressing a mixture to form the mixture into a brick shape. Further, the amount of mixture to be put in a space defined by the metal frame and the lower liner can be changed to mold a plurality of types of bricks different only in terms of the width dimension.

Figure 3A:
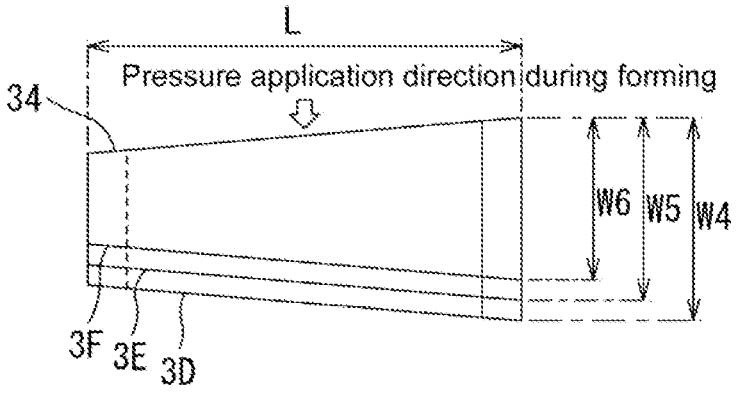
FIG. 3A is an explanatory diagram of three bricks to be used, respectively, in a 14th tier, a 15th tier, and a 16th tier, in the lining of the side wall of the converter illustrated in FIG. 1A.

FIG. 3A is a top plan view showing a state in which the brick 3D to be used in the 14th tier, the brick 3E to be used in the 15th tier and the brick 3F to be used in the 16th tier are superimposed on each other in their height direction, while the respective circumferential side faces 34 of the superimposed bricks 3D to 3F are arranged to be flush with each other. The undermost brick 3D is used in the 14th tier, i.e., disposed on the tier region having a relatively large pre-lining radius, so that it is relatively large in terms of the back face width. The back face width becomes smaller as the pre-lining radius becomes smaller. Similarly, the brick 3G to be used in the 17th tier and the brick 3H to be used in the 18th tier become smaller in terms of the back face width in this order, although not shown in FIG. 3A. That is, the back face width W4 of the brick 3D (for the 14th tier)>the back face width W5 of the brick 3E (for the 15th tier)>the back face width W6 of the brick 3F (for the 16th tier)>the back face width of the brick 3G (for the 17th tier)>the back face width of the brick 3H (for the 18th tier).

Figure 3B:
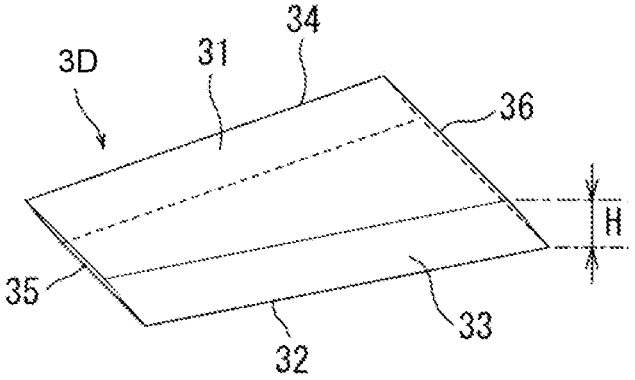
FIG. 3B is a perspective view of the brick to be used in the 14th tier, in the lining of the side wall of the converter illustrated in FIG. 1A.

FIG. 3B is a perspective view of the brick 3D to be used in the 14th tier, wherein, differently from the brick illustrated in FIG. 2C, each of the inner face 35 and the back face 36 are inclined with respect to the upper face 31, and these two faces (inner and back faces 35, 36) extend parallel to each other. Bricks each having a width dimension different from that of this brick 3D is used in the 15th, 16th, 17th, and 18th tiers.

As just described, the bricks to be used in the respective tiers are molded to be identical in terms of the taper angle $\alpha$, the height dimension H and the length dimension L even though the corresponding tier regions are different in terms of the pre-lining radius, so that it is possible to form these bricks into desired shapes, using a common set of a metal frame and a vertical liner, as mentioned above. Thus, there is no need for exchange work of molding dies (the metal frame and the vertical liner) during molding, and there is no concern about an increase in molding cost (manufacturing cost) even if the number of brick shapes increases. Particularly, in the converter, upper and lower parts of the peripheral portion is inwardly inclined (narrowed) as shown in FIG. 1A, so that there is a plurality of tier regions different in terms of the pre-lining radius. In this situation, the application of the present invention makes it possible to significantly effectively improve efficiency of lining work without causing any increase in manufacturing cost.

Further, in each of the tier regions identical in terms of the pre-lining radius, i.e., the 3rd to 13th tier regions, identically-shaped bricks can be used, so that it is possible to improve efficiency of the lining work without causing any increase in cost of packing work In FIG. 1A, all bricks for a lining to be formed on one tier region are formed equally in terms of the length dimension. Alternatively, bricks different in terms of the length dimension may be partly used, as long as they are identical in terms of the taper angle. For example, there are some cases where a brick having a relatively long length dimension is disposed on a tier region of the sidewall of the converter which is likely to undergo severe wear damage, such as the vicinity of a tap hole of the converter. In these cases, the brick lining forming method of the present invention may be applied to such a tier region. Specifically, a 900 mm-length brick is used in the tier region which is likely to undergo severe wear damage, and each of the remaining tier regions is lined with two types of bricks: the 900 mm-length brick; and 800 mm-length brick. That is, the point of the brick lining forming method of the present invention is in that "only bricks identical in terms of the taper angle and the height dimension are used, except for an adjustment brick, in each of the two or more tier regions different in terms of the pre-lining radius, wherein bricks identical in terms of the taper angle, the height dimension and length dimension, and different in terms of the back face width, are used in at least a part of each of the two or more tier regions", i.e., the bricks identical in terms of the taper angle, the height dimension and length dimension may be used in "at least part" of each of the two or more tier regions. In other words, the bricks identical in terms of the taper angle, the height dimension and length dimension may be used in "at least part" of each of the two or more tier regions different in terms of the pre-lining radius. Here, FIG. 1A shows a case where the bricks identical in terms of the taper angle, the height dimension and length dimension are used in "each" of the two or more tier regions different in terms of the pre-lining radius. In this case, the efficiency of the lining work is most improved. Thus, from a viewpoint of the improvement in efficiency of the lining work, it is most preferable to adopt the "each" configuration as shown in FIG. 1A. When adopting the "at least a part" configuration, it is preferable that the brick identical in terms of the taper angle, the height dimension and length dimension is used in 50% (one-half) or more of each of the two or more tier regions.

Further, only bricks identical in terms of the taper angle and the height dimension are used, except for an adjustment brick, in each of the remaining tier regions identical in terms of the pre-lining radius, wherein bricks identical in terms of the taper angle, the height dimension, the length dimension and the back face width are used in at least a part of each of the remaining tier regions. With regard to the "at least a part" configuration in this case, the above rate is also applied.

In the case where two types of bricks different in terms of the length dimension are used in each tier region (in the above "at least part" configuration), the number of brick shapes per tier in the conventional brick lining forming method is four, whereas the number of brick shapes per tier in the present invention is only two. Thus, it is possible to obtain an advantageous effect of reduction in workload of molding work, workload of the packing work and workload of the lining work.

Further, FIG. 1A shows an example in which the present invention is applied to a sidewall of one converter, wherein the sidewall has two or more tier regions different in terms of the pre-lining radius. The present invention can also be applied to a case where respective sidewalls of plural types of converters and other kilns/furnaces different in terms of the pre-lining radius are lined. The same set of molding dies (a metal frame and a vertical liner) can be used for a plurality of kilns/furnaces, so that it is possible to line the peripheral portion of the sidewall of each of the kilns/furnaces without causing any increase in manufacturing cost.

As mentioned above, as bricks for use in the present invention, plural types of bricks shaped differently in terms of the inner face width and the back face width can be molded by uniaxially applying pressure to a mixture in manner allowing a pressure-receiving part of the mixture to be formed as at least one of the circumferential side faces, using one set of the metal frame and the vertical liner, while adjusting the amount of the mixture to be put inside the metal frame. Here, manufacturing steps other than molding, i.e., kneading, drying, heat treatment and the like, can be conducted in the same manner as before. Further, in the above embodiment, a key shape and a similar shape thereto are shown as brick shape. Alternatively, an arch shape and a wedge shape may be used.

Examples

Next, an inventive example in which the brick lining forming method of the present invention is applied to an actual converter will be described.

Figure 4:
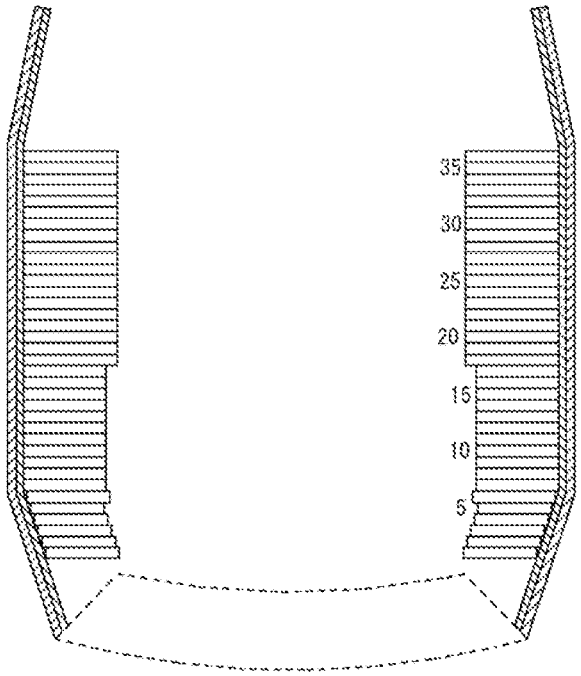
FIG. 4 is a vertical sectional view schematically showing an actual converter to explain one inventive example of the brick lining forming method of the present invention.

FIG. 4 is a vertical sectional view schematically showing an actual converter subjected to a lining test. In FIGS. 4, 1*st* to 36th tier regions were lined by the brick lining forming method of the present invention, and 37th to n-th tier regions (n is an integer of 37 or more) was lined one-by-one with a combination of two types of conventional bricks shaped differently in terms of the taper angle. It should be noted here that any lining on tier regions other than those lined by the brick lining forming method of the present invention is omitted in FIG. 4.

In a peripheral portion of this converter, the 7th to 36th tier regions form an inner surface of a straight barrel part having a pre-lining radius of 4000 mm, and a part thereof below the 6th tier regions is reduced in the pre-lining radius. A brick having a length dimension of 720 mm was used in the 1st to 5th tier regions. Further, a brick having a length dimension of 810 mm was used in the 6th to 17th tier regions, and a brick having a length dimension of 900 mm was used in the 18th to 36th tier regions. Further, all bricks had a taper angle of 2.25°, and a height dimension of 150 mm. However, the back face width of the brick in the straight barrel part (the 7th to 36th tier regions) was set to 157 mm, and the back face width of the brick in the tier region having a relatively small pre-lining radius was set to be less than that of the brick in the straight barrel part.

Table 1 shows a brick shape, a packing method, a molding method and workloads of various works, in the inventive example, in such a manner as to compare them with those in a comparative example. The comparative example is a conventional brick lining forming method in which two types of bricks shaped differently in terms of the taper angle are used in each tier region. Further, each of the bricks used in the inventive and comparative examples was molded under the condition that a pressure-receiving part (a contact part with a vertical liner) of a mixture is formed as the circumferential side faces.

TABLE 1

| | | Inventive Example | Comparative Example |
|---|---|---|---|
| 1st to 5th tiers Length of brick: 720 mm | Brick shape | Five types of bricks shaped differently in terms of back face width, for use in respective tiers | Two types of bricks shaped differently in terms of taper angle |
| | Packing method | One/pallet | Two/pallet |
| | Total number of brick shapes | 5 | 2 |
| | Metal frame (assembly) used during molding | 1 | 1 |
| | Vertical liner (assembly) used during molding | 1 | 2 |
| | Workload (index) of molding work | 95 | 100 |
| | Workload (index) of packing work | 70 | 100 |
| | Workload (index) of lining work | 90 | 100 |
| 6th and 7th tiers Length of brick: 810 mm | Brick shape | Two types of bricks shaped differently in terms of back face width, for use in respective tiers | Two types of bricks shaped differently in terms of taper angle |
| | Packing method | One/pallet | Two/pallet |
| | Total number of brick shapes | 2 | 2 |
| | Metal frame (assembly) used during molding | 1 | 1 |
| | Vertical liner (assembly) used during molding | 1 | 2 |
| | Workload (index) of molding work | 95 | 100 |
| | Workload (index) of packing work | 70 | 100 |
| | Workload (index) of lining work | 90 | 100 |
| 8th to 17th tiers Length of brick: 810 mm | Brick shape | One | Two |
| | Packing method | One/pallet | Two/pallet |
| | Total number of brick shapes | 1 (same as that in 7th tier) | 2 (same as that in 7th tier) |
| | Metal frame (assembly) used during molding | 1 (same as that in 7th tier) | 1 (same as that in 7th tier) |
| | Vertical liner (assembly) used during molding | 1 (same as that in 7th tier) | 2 (same as that in 7th tier) |
| | Workload (index) of molding work | 95 | 100 |
| | Workload (index) of packing work | 70 | 100 |
| | Workload (index) of lining work | 90 | 100 |
| 18th to 36th tiers Length of brick: 900 mm | Brick shape | One | Two |
| | Packing method | One/pallet | Two/pallet |
| | Total number of brick shapes | 1 | 2 |
| | Metal frame (assembly) used during molding | 1 | 1 |
| | Vertical liner (assembly) used during molding | 1 | 2 |
| | Workload (index) of molding work | 95 | 100 |
| | Workload (index) of packing work | 70 | 100 |
| | Workload (index) of lining work | 90 | 100 |

With reference to Table 1, the inventive and comparative examples will be described in detail below. It should be noted here that each of the workloads of various works is expressed as an index calculated on the assumption that a respective one of the workloads of various works in the comparative example is 100.

[1st to 5th Tiers]

In the inventive example, total five types of differently-shaped bricks were used, wherein the number of brick shapes was one in each tier, but each tier was different in terms of the back face width and the inner face width. As the packing method, only identically-shaped bricks were packed in one pallet. Further, during molding, the amount of mixture to be put in a metal frame was changed to change the width dimension. Therefore, only a set of one type of metal frame and one type of vertical liner was used for all bricks.

On the other hand, in the comparative example, two types of bricks shaped differently only in terms of the taper angle were used. As the packing method, the two types of differently-shaped bricks were arranged and packed in one pallet in a given order according to which the bricks are laid in a converter. Further, during molding, two types of vertical liners were used to change the taper angle.

With regard to the total number of brick shapes, in the inventive example, it was five because each of the 1st to 5th tiers was different in terms of the width dimension. On the other hand, in the comparative example, it was two, wherein the two brick shapes were different in terms of the taper angle.

In a brick molding process, in the inventive example, bricks can be molded using one type of vertical liner, because the bricks are identical in terms of the length dimension and the taper angle, whereas the comparative example requires using two types of vertical liners to change the taper angle, so that it is necessary to additionally perform vertical liner exchange work, resulting in an increase in workload of the molding work.

With regard to the workload of the packing work, in the inventive example, it is only necessary to pack identically-shaped bricks in one pallet, whereas in the comparative example, it is necessary to arrange two types of differently-shaped bricks in one pallet in a given order, resulting in a significant increase in workload of the packing work.

With regard to the workload of the lining work, in the comparative example, when the bricks arranged in the given order are taken out from the pallet, it is necessary to check the bricks for shape one-by-one, so that efficiency of the lining work was inferior to that of the inventive example.

[6th and 7th Tiers]

In the inventive example, total two types of differently-shaped bricks were used, wherein the number of brick shapes is one in each tier, but each of the two tiers was different in terms of the back face width and the inner face width. As the packing method, only identically-shaped bricks are packed in one pallet. These bricks are different from the bricks in the 1st to 5th tiers in terms of the length dimension. Thus, during molding, a set of a metal frame and a vertical liner having a length dimension greater than that of the set for the bricks in the 1st to 5th tiers was used. Here, the width dimension was changed by changing the amount of mixture to be put in a metal frame. Therefore, only a set of one type of metal frame and one type of vertical liner was used for all bricks.

On the other hand, in the comparative example, two types of bricks shaped differently only in terms of the taper angle were used. As the packing method, the two types of differently-shaped bricks were arranged and packed in one pallet in a given order according to which the bricks are laid in a converter. Further, during molding, a set of a metal frame and a vertical liner having a length dimension different from that of the set for the bricks in the 1st to 5th tiers was used, and, differently from the inventive example, two types of vertical liners were used to change the taper angle.

With regard to the total number of brick shapes, in the inventive example, it was two because each of the 6th and 7th tiers was different in terms of the width dimension. On the other hand, in the comparative example, it was two, wherein the two brick shapes were different in terms of the taper angle.

In a brick molding process, the inventive example requires work for exchanging the set of the metal frame and the vertical liner, because the bricks are different from those in the 1st to 5th tiers in terms of the length dimension, whereas the comparative example further requires using two types of vertical liners, so that it is necessary to additionally perform vertical liner exchange work, resulting in an increase in workload of the molding work.

With regard to the workload of the packing work, in the inventive example, it is only necessary to pack identically-shaped bricks in one pallet, whereas, in the comparative example, it is necessary to arrange two types of differently-shaped bricks in one pallet in a given order, resulting in an increase in workload of the packing work.

With regard to the workload of the lining work, in the comparative example, when the bricks arranged in the given order are taken out from the pallet, it is necessary to check the bricks for shape one-by-one, so that efficiency of the lining work was inferior to that of the inventive example.

[8th and 17th Tiers]

In the inventive example, the same brick as that in the 7th tier was used, wherein, as the packing method, identically-shaped bricks were packed in one pallet, and a set of one type of metal frame and one type of vertical liner was used for all bricks.

On the other hand, in the comparative example, two types of bricks shaped differently in terms of the taper angle were used as with the bricks in the 7th tier. As the packing method, the two types of differently-shaped bricks were arranged and packed in one pallet in a given order according to which the bricks are laid in a converter. Further, during molding, two types of vertical liners were used to change the taper angle.

In a brick molding process, both the inventive example and the comparative example do not require metal frame exchange work, because the same brick as that in the 7th tier can be used in each of the examples. However, the comparative example requires using two types of vertical liners to change the taper angle, so that it is necessary to additionally perform vertical liner exchange work, resulting in an increase in workload of the molding work.

With regard to the workload of the packing work, in the inventive example, it is only necessary to pack identically-shaped bricks in one pallet, whereas, in the comparative example, it is necessary to arrange two types of differently-shaped bricks in one pallet in a given order, resulting in a significant increase in workload of the packing work.

With regard to the workload of the lining work, in the comparative example, when the bricks arranged in the given order are taken out from the pallet, it is necessary to check the bricks for shape one-by-one, so that efficiency of the lining work was inferior to that of the inventive example.

[18th to 36th Tiers]

In the inventive example, identically-shaped bricks were used, wherein, as the packing method, the identically-shaped bricks were packed in one pallet. However, the bricks are different from those in the 7th to 17th tiers in terms of the length dimension. Thus, during molding, a set of a metal frame and a vertical liner having a length dimension greater than that of the set for the bricks in the 7st to 17th tiers was used, On the other hand, in the comparative example, two types of bricks shaped differently in terms of the taper angle were used. As the packing method, the two types of differently-shaped bricks were arranged and packed in one pallet in a given order according to which the bricks are laid in a converter. Further, during molding, a set of a metal frame and a vertical liner having a length dimension greater than that of the set for the bricks in the 7th to 17th tiers was used, and two types of vertical liners were used to mold bricks different in terms of the taper angle.

In a brick molding process, the inventive example requires work for exchanging the set of the metal frame and the vertical liner used for the bricks in the 7th to 17th tiers for a set of a metal frame and a vertical liner having a longer length dimension. On the other hand, the comparative example further requires work for exchanging the two types of vertical liners to mold two types of bricks shaped differently in terms of the taper angle, so that the comparative example needs a larger workload of the molding work.

With regard to the workload of the packing work, in the inventive example, it is only necessary to pack identically-shaped bricks in one pallet, whereas, in the comparative example, it is necessary to arrange two types of differently-shaped bricks in one pallet in a given order, resulting in an increase in workload of the packing work.

With regard to the workload of the lining work, in the comparative example, when the bricks arranged in the given order are taken out from the pallet, it is necessary to check the bricks for shape one-by-one, so that efficiency of the lining work was inferior to that of the inventive example.

The inventive and comparative examples have been described without making mention of the use of an adjustment brick. When bricks are laid along the circumference of the shell (inner periphery of the permanent refractory material), the shape of a brick to be lastly laid is likely not to be constant due to fluctuation of the size of a finally formed gap. As used in this specification, the term "adjustment brick" means a brick which is produced by measuring the size of the gap and processing a brick material in conformity to the measured size, and is to be driven into the gap so as to fill the gap and prevent the laid bricks from being untightened in a circumferential direction. In the above inventive and comparative examples, the adjustment brick is appropriately used. However, a workload caused by using the adjustment brick is approximately the same between the inventive and comparative examples. Thus, the use of the adjustment brick does not exert any influence on the aforementioned comparison between the workloads of the inventive and comparative examples.

In the above inventive example, the 1st to 36th tier regions are lined by the brick lining forming method of the present invention, and the 37th to n-th tiers are lined by the conventional brick lining forming method. It is to be understood that the inventive example falls within the scope of the present invention as defined by the appended claims, as long as the 1st to 36th tier regions are lined by the brick lining forming method of the present invention.

LIST OF REFERENCE SIGNS

1: shell
2: permanent refractory material
3A to 3H: brick
31: upper face
32: lower face
33: circumferential side face
34: circumferential side face
35: inner face
36: back face

The invention claimed is:

1. A brick lining forming method comprising stacking a plurality of tiers of bricks, respectively, on a plurality of tier regions of an inner surface of a hollow substantially cylindrical-shaped peripheral portion of a kiln or furnace to construct a side wall of the kiln or furnace, wherein two or more of the plurality of tier regions are different in terms of pre-lining radius and remaining tier regions are identical in terms of the pre-lined radius, wherein, with the kiln or furnace lined with the bricks: two circumferentially opposed side faces of each of the bricks are defined as circumferential side faces; an angle between the circumferential side faces is defined as a taper angle; and a circumferential dimension of a back face of each of the bricks is defined as a back face width, only bricks identical in terms of the taper angle and height dimension are used, except for an adjustment brick having a taper angle and/or a height dimension differing from that of the bricks identical in terms of the taper angle and height dimension, in each of the two or more tier regions, wherein among the bricks identical in terms of the taper angle and the height dimension, bricks identical in terms of length dimension but different in terms of the back face width, are used in at least a part of each of the two or more tier regions, wherein each of the plurality of tiers of bricks is formed by sequentially arranging bricks on a respective one of the plurality of tier regions of the inner surface of the peripheral portion of the kiln or furnace in a circumferential direction of the peripheral portion, and wherein the plurality of tiers of bricks are stacked, respectively, on the plurality of tier regions of the kiln or furnace in an upward-downward direction to construct the side wall of the kiln or furnace.

2. The brick lining forming method as claimed in claim 1, wherein only bricks identical in terms of the taper angle and the height dimension are used, except for an adjustment brick having a taper angle and/or a height dimension differing from that of the bricks identical in terms of the taper angle and height dimension, in each of the remaining tier regions identical in terms of the pre-lining radius, wherein bricks identical in terms of the taper angle, the height dimension, the length dimension and the back face width are used in at least a part of each of the remaining tier regions.

3. The brick lining forming method as claimed in claim 1, wherein the kiln or furnace is a converter.

4. The brick lining forming method as claimed in claim 2, wherein each of the bricks is molded while pressure is uniaxially applied to a mixture in a manner allowing a pressure-receiving part of the mixture to be formed as at least one of the circumferential side faces.

5. The brick lining forming method as claimed in 5, wherein the kiln or furnace is a converter.

6. The brick lining forming method as claimed in 2, wherein the kiln or furnace is a converter.

7. The brick lining forming method as claimed in claim 1, wherein during manufacturing of the bricks identical in terms of the taper angle, the height dimension and length dimension, but different in terms of the back face width, each of the bricks is molded in the same frame and vertical line while pressure is uniaxially applied to a mixture in a manner allowing a pressure-receiving part of the mixture to be formed as at least one of the circumferential side faces.

* * * * *